US011383959B1

(12) United States Patent
Cornett, Jr.

(10) Patent No.: US 11,383,959 B1
(45) Date of Patent: Jul. 12, 2022

(54) METHOD FOR EXPANDING A RISE OF AN ELEVATOR HOISTWAY

(71) Applicant: Otis Elevator Company, Farmington, CT (US)

(72) Inventor: Paul Thomas Cornett, Jr., Florence, SC (US)

(73) Assignee: OTIS ELEVATOR COMPANY, Farmington, CT (US)

( * ) Notice: Subject to any disclaimer, the term of this patent is extended or adjusted under 35 U.S.C. 154(b) by 2 days.

(21) Appl. No.: 17/166,325

(22) Filed: Feb. 3, 2021

(51) Int. Cl.
*B66B 19/00* (2006.01)
*B66B 5/00* (2006.01)
*B66B 11/00* (2006.01)

(52) U.S. Cl.
CPC ..... *B66B 19/002* (2013.01); *B66B 5/0087* (2013.01); *B66B 11/0005* (2013.01)

(58) Field of Classification Search
CPC . B66B 19/002; B66B 5/0087; B66B 11/0005; B66B 19/005; B66B 19/007; B66B 19/02
See application file for complete search history.

(56) References Cited

U.S. PATENT DOCUMENTS 3,519,101 A * 7/1970 Sieffert ..... B66B 9/187 187/256
6,672,013 B1 * 1/2004 Glassey ..... B66B 19/002 187/408
7,635,049 B2 * 12/2009 Van Der Meijden ..... B66B 19/002 187/401
9,617,121 B2 * 4/2017 Bolme ..... B66B 19/002
11,053,098 B2 * 7/2021 Christen ..... B66B 11/0005
11,208,296 B2 * 12/2021 Christen ..... B66B 19/002
2009/0097952 A1 * 4/2009 Swaybill ..... B66B 19/005 414/800
2009/0223751 A1 * 9/2009 Peacock ..... B66B 19/00 187/414
2010/0133048 A1 * 6/2010 Barneman ..... B66B 19/00 187/414
2012/0291395 A1 * 11/2012 Plathin ..... B66B 19/02 52/741.1
2014/0000987 A1 * 1/2014 Peacock ..... B66B 9/187 187/414
2018/0186607 A1 * 7/2018 Ratia ..... B66B 19/04
2018/0290863 A1 * 10/2018 Peacock ..... E04G 3/18

* cited by examiner

*Primary Examiner* — Michael A Riegelman
(74) *Attorney, Agent, or Firm* — Cantor Colburn LLP

(57) ABSTRACT

Disclosed is a method of expanding an elevator system in a hoistway, involving: connecting an elevator car at a first level to an overhead winch that is connected to a hoist-beam at a second level, the elevator car being supported by a rail system, the rail system defining, at a first level, first and second rails with first and second rail terminal ends; connecting a machine system mounted to the first rail terminal end to a machine hoist mounted at the second level; removing a dead-end hitch from the second rail terminal end; hoisting the machine system to the second level; extending the rail system to the second level to define third and fourth rail terminal ends; hoisting the elevator car and the dead-end hitch to the second level; and installing the machine system and the dead-end hitch at the second level, to the third and fourth rail terminal ends.

15 Claims, 17 Drawing Sheets

METHOD FOR EXPANDING A RISE OF AN ELEVATOR HOISTWAY

BACKGROUND

The embodiments relate to an or elevator system and more specifically to a method for expanding a rise of an elevator hoistway.

Modular building construction design restricts the use of a traditional outside material hoist. This drives the need for a temporary use elevator in the permanent hoistway of the building. As floors are added, the elevator should be relatively quickly able to service the new landings without disrupting the construction of the modular building.

BRIEF SUMMARY

Disclosed is a method of expanding an elevator system in a hoistway, including: connecting an elevator car at a first hoistway level to an overhead winch that is connected to a hoist-beam at a second hoistway level, wherein the elevator car is supported by a rail system disposed in the hoistway, wherein the rail system defines, at the first hoistway level, first and second rails that respectively define first and second rail terminal ends; connecting a machine system mounted to the first rail terminal end to a machine hoist mounted at the second hoistway level; removing a dead-end hitch from the second rail terminal end; hoisting the machine system, via the machine hoist, to the second hoistway level; extending the rail system to the second hoistway level to define third and fourth rail terminal ends; hoisting the elevator car and the dead-end hitch, via the overhead winch, to the second hoistway level; and installing the machine system and the dead-end hitch at the second hoistway level, to respective ones of the third and fourth rail terminal ends.

In addition to one or more of the above disclosed aspects, or as an alternate, prior to connecting the elevator car to the overhead winch, the method includes: raising an overhead deck and the hoist-beam from the first hoistway level to the second hoistway level, to thereby increase a rise of the hoistway.

In addition to one or more of the above disclosed aspects, or as an alternate, prior to hoisting the elevator car, the method includes: disconnecting a suspension implement between the machine system and the elevator car; disconnecting a hoistway mounted brake implement from the elevator car; and extending the hoistway mounted brake implement to define an extended hoistway mounted brake implement, and connecting the extended hoistway mounted brake implement to the elevator car; and after hoisting the elevator car, the method includes: extending the suspension implement to define extended suspension implement, and connecting the extended suspension implement between the machine system and the elevator car.

In addition to one or more of the above disclosed aspects, or as an alternate, between raising the overhead deck and connecting the machine system to the machine hoist, the method includes: mounting the machine hoist at the second hoistway level; and after installing the dead-end hitch at the second hoistway level, the method includes: removing the machine hoist.

In addition to one or more of the above disclosed aspects, or as an alternate, between raising the overhead deck and connecting the elevator car to the overhead winch, the method includes: connecting the overhead winch to the hoist-beam; and after installing the dead-end hitch at the second hoistway level, the method includes: removing the overhead winch.

In addition to one or more of the above disclosed aspects, or as an alternate, the method includes supporting the dead-end hitch against the elevator car prior to hoisting the elevator car to the second hoistway level.

In addition to one or more of the above disclosed aspects, or as an alternate, prior to hoisting the elevator car to the second hoistway level, the method includes: disconnecting system electronics from the elevator car; and after hoisting the elevator car to the second hoistway level, the method includes: reconnecting the system electronics to the elevator car.

In addition to one or more of the above disclosed aspects, or as an alternate, after removing the machine hoist and the overhead winch, the method includes: testing the elevator system; and returning the elevator system to service.

In addition to one or more of the above disclosed aspects, or as an alternate, extending the rail system to the second hoistway level includes: installing rail system extension members to the first and second rails, to define first and second extended rail members, wherein the first and second extended rail members define the third and fourth rail terminal ends at the second hoistway level.

In addition to one or more of the above disclosed aspects, or as an alternate, the hoistway mounted brake implement includes governor and a governor cable.

In addition to one or more of the above disclosed aspects, or as an alternate, extending the hoistway mounted brake implement includes: (i) relocating the governor to the second hoistway level; (ii) extending the governor cable to define an extended governor cable; and (iii) connecting the extended governor cable to the governor.

In addition to one or more of the above disclosed aspects, or as an alternate, the rail system includes guide rails.

In addition to one or more of the above disclosed aspects, or as an alternate, the machine system includes a traction machine and its bedplate.

In addition to one or more of the above disclosed aspects, or as an alternate, the suspension implement includes a coated steel belt.

In addition to one or more of the above disclosed aspects, or as an alternate, the system electronics include an electronic elevator controller.

BRIEF DESCRIPTION OF THE DRAWINGS

The present disclosure is illustrated by way of example and not limited in the accompanying figures in which like reference numerals indicate similar elements.

DETAILED DESCRIPTION

Figure 1:
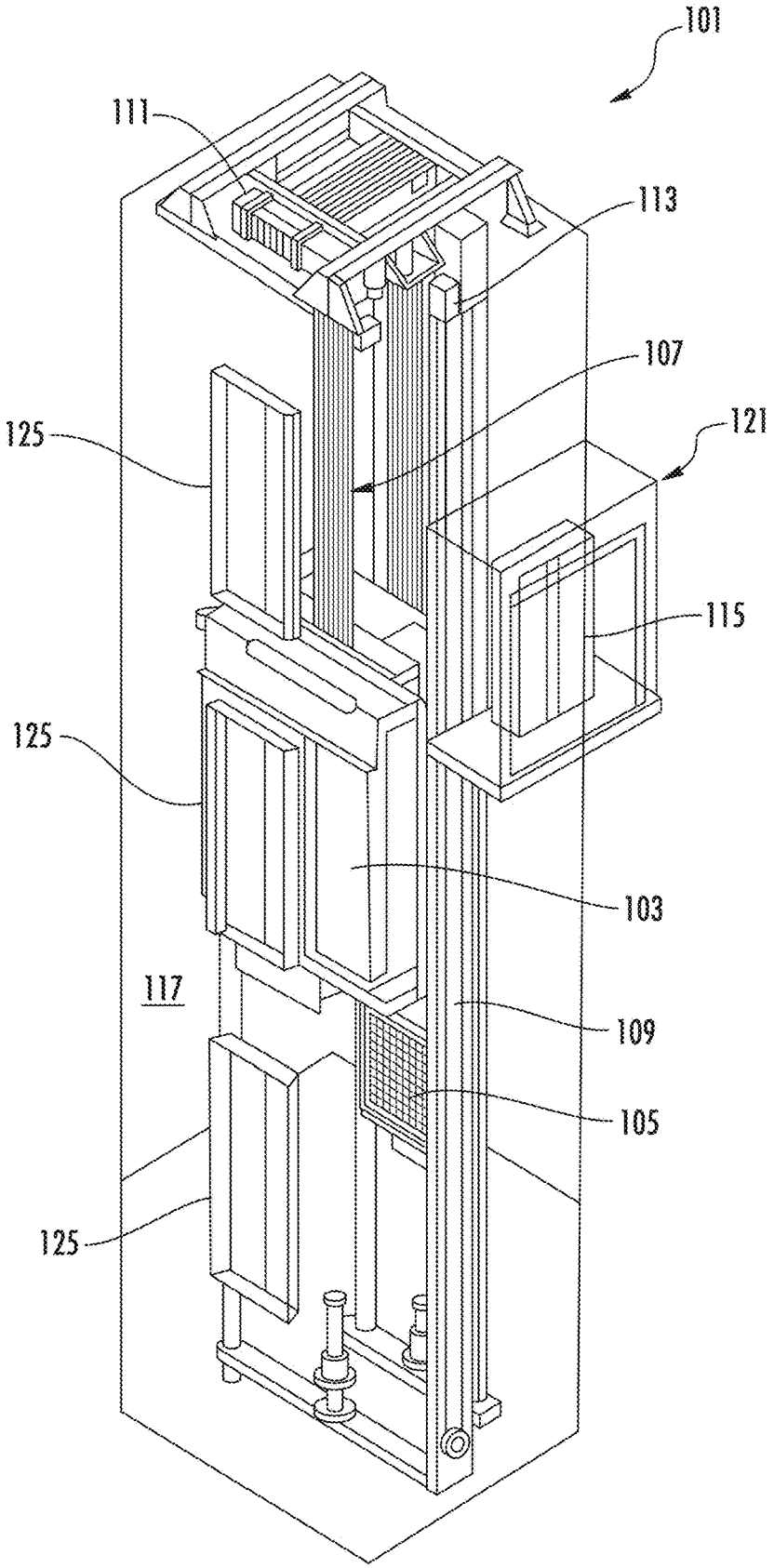
FIG. 1 is a schematic illustration of an elevator system that may employ various embodiments of the present disclosure.

FIG. 1 is a perspective view of an elevator system 101 including an elevator car 103, a counterweight 105, a tension member 107, a guide rail (or rail system) 109, a machine (or machine system) 111, a position reference system 113, and an electronic elevator controller (controller) 115. The elevator car 103 and counterweight 105 are connected to each other by the tension member 107. The tension member 107 may include or be configured as, for example, ropes, steel cables, and/or coated-steel belts. The counterweight 105 is configured to balance a load of the elevator car 103 and is configured to facilitate movement of the elevator car 103 concurrently and in an opposite direction with respect to the counterweight 105 within an elevator shaft (or hoistway) 117 and along the guide rail 109.

The tension member 107 engages the machine 111, which is part of an overhead structure of the elevator system 101. The machine 111 is configured to control movement between the elevator car 103 and the counterweight 105. The position reference system 113 may be mounted on a fixed part at the top of the elevator shaft 117, such as on a support or guide rail, and may be configured to provide position signals related to a position of the elevator car 103 within the elevator shaft 117. In other embodiments, the position reference system 113 may be directly mounted to a moving component of the machine 111, or may be located in other positions and/or configurations as known in the art. The position reference system 113 can be any device or mechanism for monitoring a position of an elevator car and/or counterweight, as known in the art. For example, without limitation, the position reference system 113 can be an encoder, sensor, or other system and can include velocity sensing, absolute position sensing, etc., as will be appreciated by those of skill in the art.

The controller 115 is located, as shown, in a controller room 121 of the elevator shaft 117 and is configured to control the operation of the elevator system 101, and particularly the elevator car 103. For example, the controller 115 may provide drive signals to the machine 111 to control the acceleration, deceleration, leveling, stopping, etc. of the elevator car 103. The controller 115 may also be configured to receive position signals from the position reference system 113 or any other desired position reference device. When moving up or down within the elevator shaft 117 along guide rail 109, the elevator car 103 may stop at one or more landings 125 as controlled by the controller 115. Although shown in a controller room 121, those of skill in the art will appreciate that the controller 115 can be located and/or configured in other locations or positions within the elevator system 101. In one embodiment, the controller may be located remotely or in the cloud.

The machine 111 may include a motor or similar driving mechanism. In accordance with embodiments of the disclosure, the machine 111 is configured to include an electrically driven motor. The power supply for the motor may be any power source, including a power grid, which, in combination with other components, is supplied to the motor. The machine 111 may include a traction sheave that imparts force to tension member 107 to move the elevator car 103 within elevator shaft 117.

Although shown and described with a roping system including tension member 107, elevator systems that employ other methods and mechanisms of moving an elevator car within an elevator shaft may employ embodiments of the present disclosure. For example, embodiments may be employed in ropeless elevator systems using a linear motor to impart motion to an elevator car. Embodiments may also be employed in ropeless elevator systems using a hydraulic lift to impart motion to an elevator car. Embodiments may also be employed in ropeless elevator systems using self-propelled elevator cars (e.g., elevator cars equipped with friction wheels, pinch wheels, or traction wheels). FIG. 1 is merely a non-limiting example presented for illustrative and explanatory purposes.

As indicated, modular building construction design restricts the use of a traditional outside material hoist, which drives the need for a temporary use elevator in the permanent hoistway of the building. As floors are added, the elevator should be relatively quickly able to service the new landings without disrupting the construction of the modular building.

Figure 2:
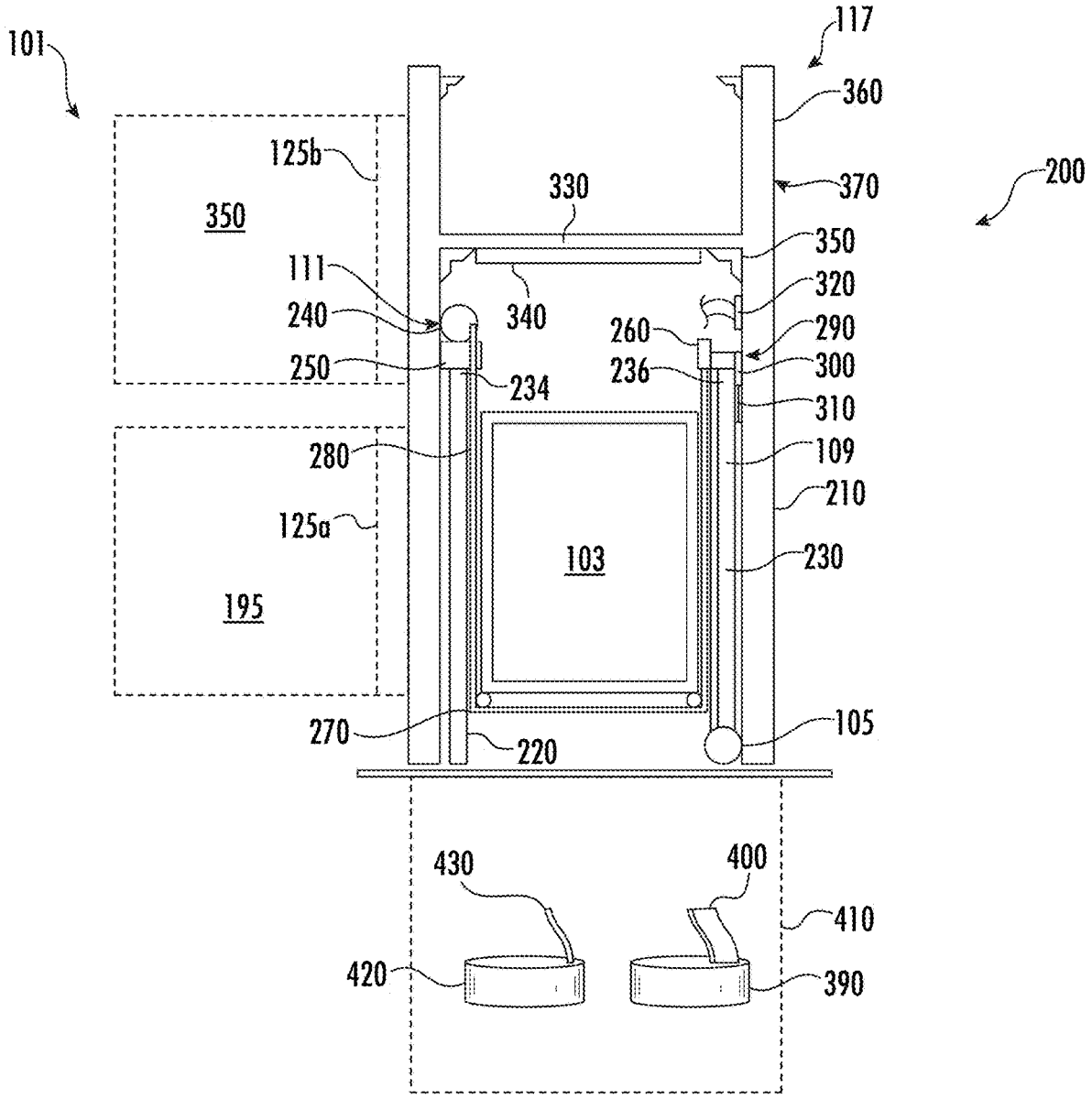
FIG. 2 shows components of an elevator system that is prepared for expansion to a second hoistway level according to an embodiment.

In view of the above concerns, the disclosed embodiments provide an installation method for expanding a rise of an elevator system 101 in a hoistway 117, which may be referred to as a jump process. Turning to FIG. 2, the figure shows a building 200 prior to expanding the rise of the elevator system 101 in the hoistway 117. A first building level 195 of the building 200 includes a first level entryway **125*a* for accessing the elevator car 103 at a first hoistway level (or first level) 210 of a hoistway 117. Within the first hoistway level 210, an elevator car 103 is supported by a rail system 109 that includes first and second rails 220, 230, which may be guide rails. The first and second rails 220, 230 respectively define first and second rail terminal ends 234, 236. A machine system 111, including a traction machine 240 and its bedplate 250, and a dead-end hitch (DEH) 260, are respectively atop the first and second rail terminal ends 234, 235. A suspension implement 270, which includes a coated steel belt (CSB) 280 connected to a counterweight 105, supports the elevator car 103. A hoistway mounted brake implement 290, which may include a governor 300 having a governor cable 310, are also mounted within the hoistway 117. In addition, system electronics with related wiring (collectively the system electronics 320), which may include the controller 115, may also be mounted within the hoistway 117. An overhead deck 330, that includes a hoist-beam 340, is mounted to first level mounts 350 at the first hoistway level 210**.

A second building level 350, which may be a modular level, is installed above first building level 195. The second building level 350 may include, preinstalled, a second level entryway **125*b* for accessing the elevator car 103 at a second hoistway level (or second level) 360 of the hoistway 117. The second hoistway level 360 may be defined by hoistway panels 370 that are preinstalled or installed on site. The hoistway panels 370 may include second level mounts 380**.

A belt spool 390 containing an extension belt segment 400 of the coated steel belt 280, required for extending the coated steel belt 280, may be stored in the hoistway pit (or pit) 410. A cable spool 420 containing an extension cable segment 430, required for extending the governor cable 310, may also be stored in the pit 410.

Figure 3:
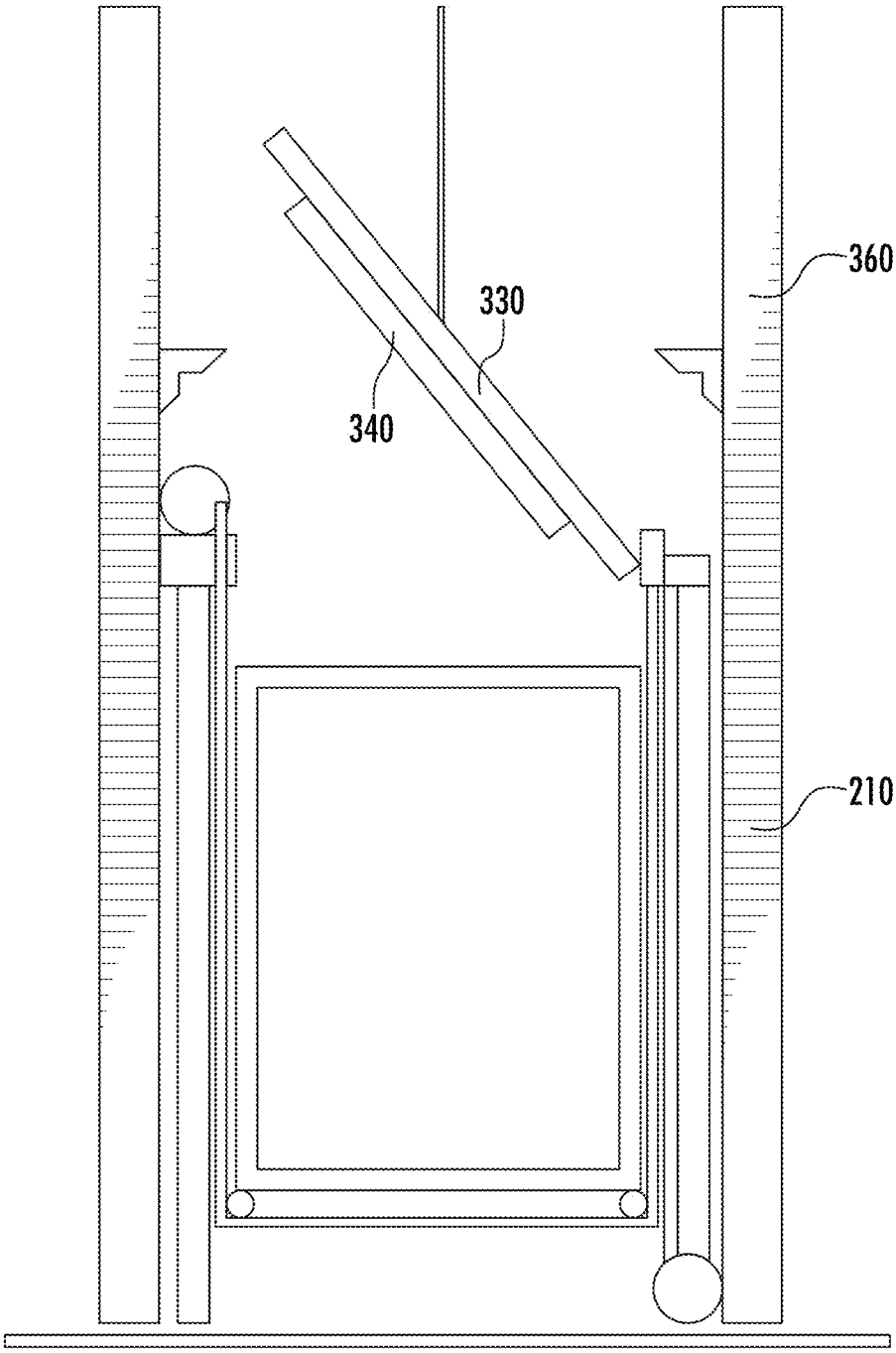
FIG. 3 shows an overhead deck moved to the second hoistway level according to an embodiment.
Figure 4:
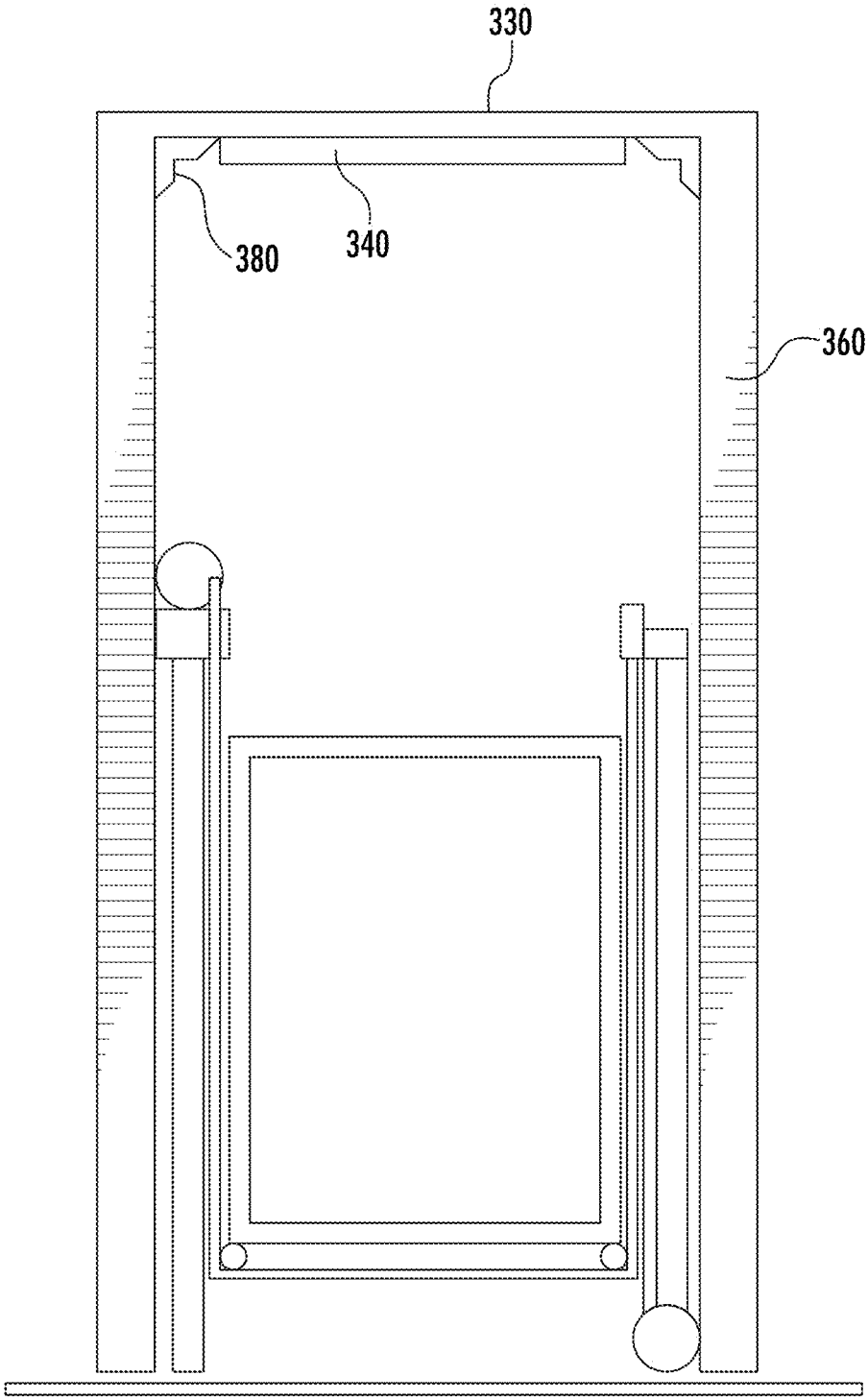
FIG. 4 shows the overhead deck mounted at the second hoistway level according to an embodiment.

Tuning to FIG. 3, the overhead deck 330 and hoist-beam 340 are raised from the first hoistway level 210 to the second hoistway level 360. Turning to FIG. 4, the overhead deck 330 and hoist-beam 340 are secured to the second hoistway level 360 via the second level mounts 380. Turning to FIG. 4, the overhead deck 330 and hoist-beam 340 are installed at the second hoistway level 360 via the second level mounts 380. This increases the rise of the hoistway 117.

Figure 5:
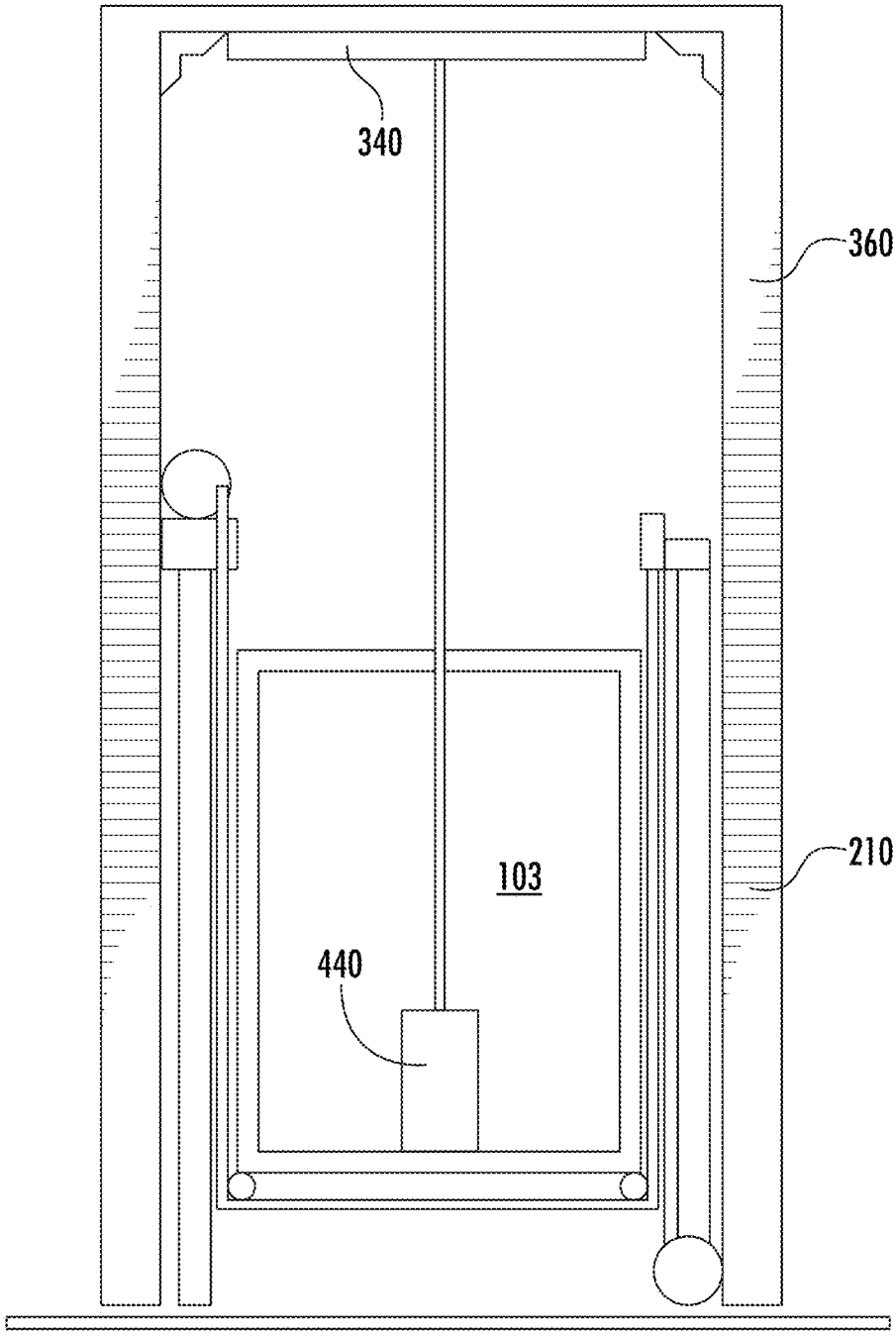
FIG. 5 shows a winch connected to the elevator car according to an embodiment.

Turning to FIG. 5, the elevator car 103, if it is not already at the top of the first hoistway level 210, is moved to the top of the first hoistway level 210. An overhead winch 440 is installed via the hoist-beam 340. The overhead winch 440 is connected to the elevator car 103. This allows the elevator car 103 to travel to the second hoistway level 360, i.e., the new rise.

Figure 6:
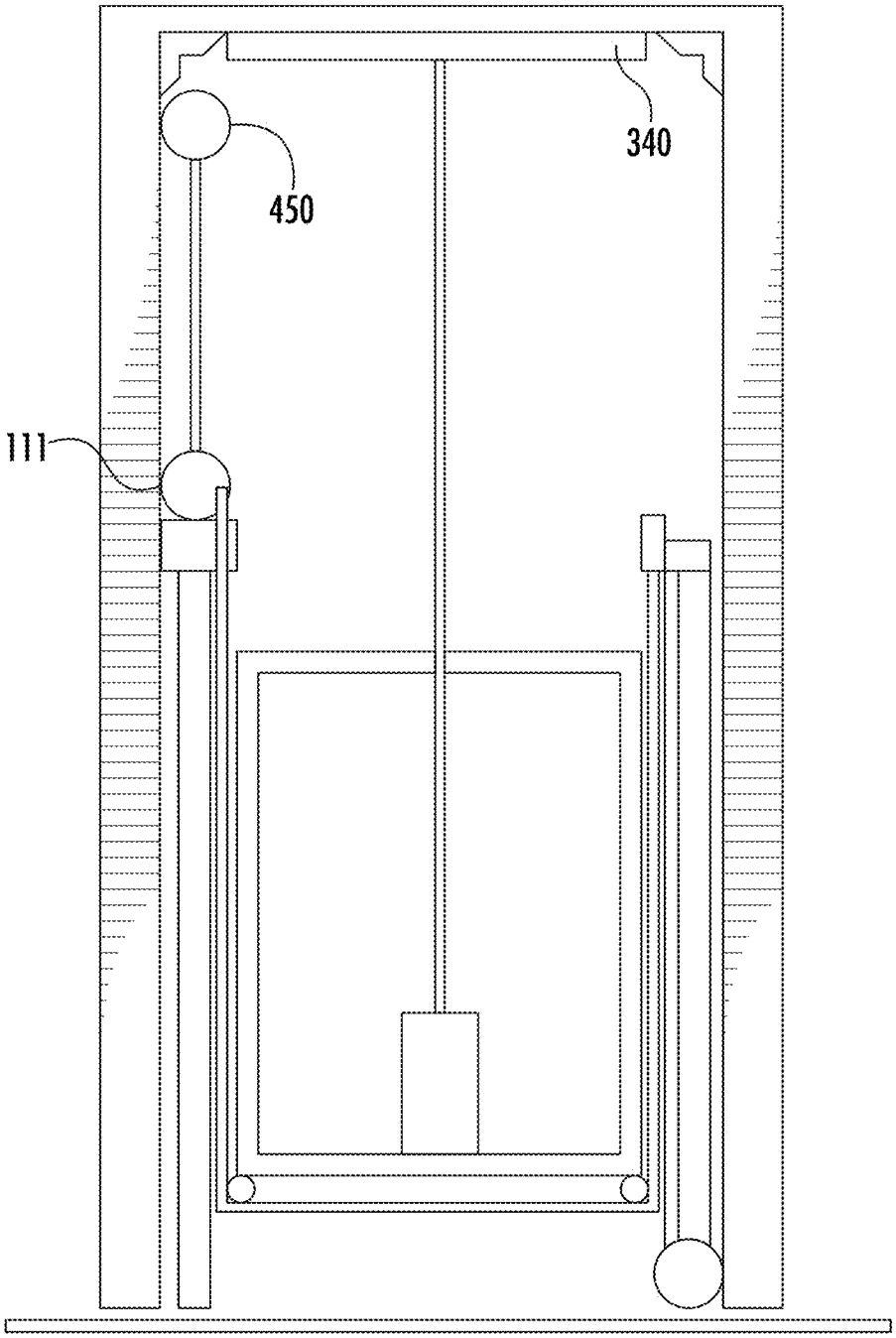
FIG. 6 shows a machine hoist mounted to a traction machine according to an embodiment.
Figure 7:
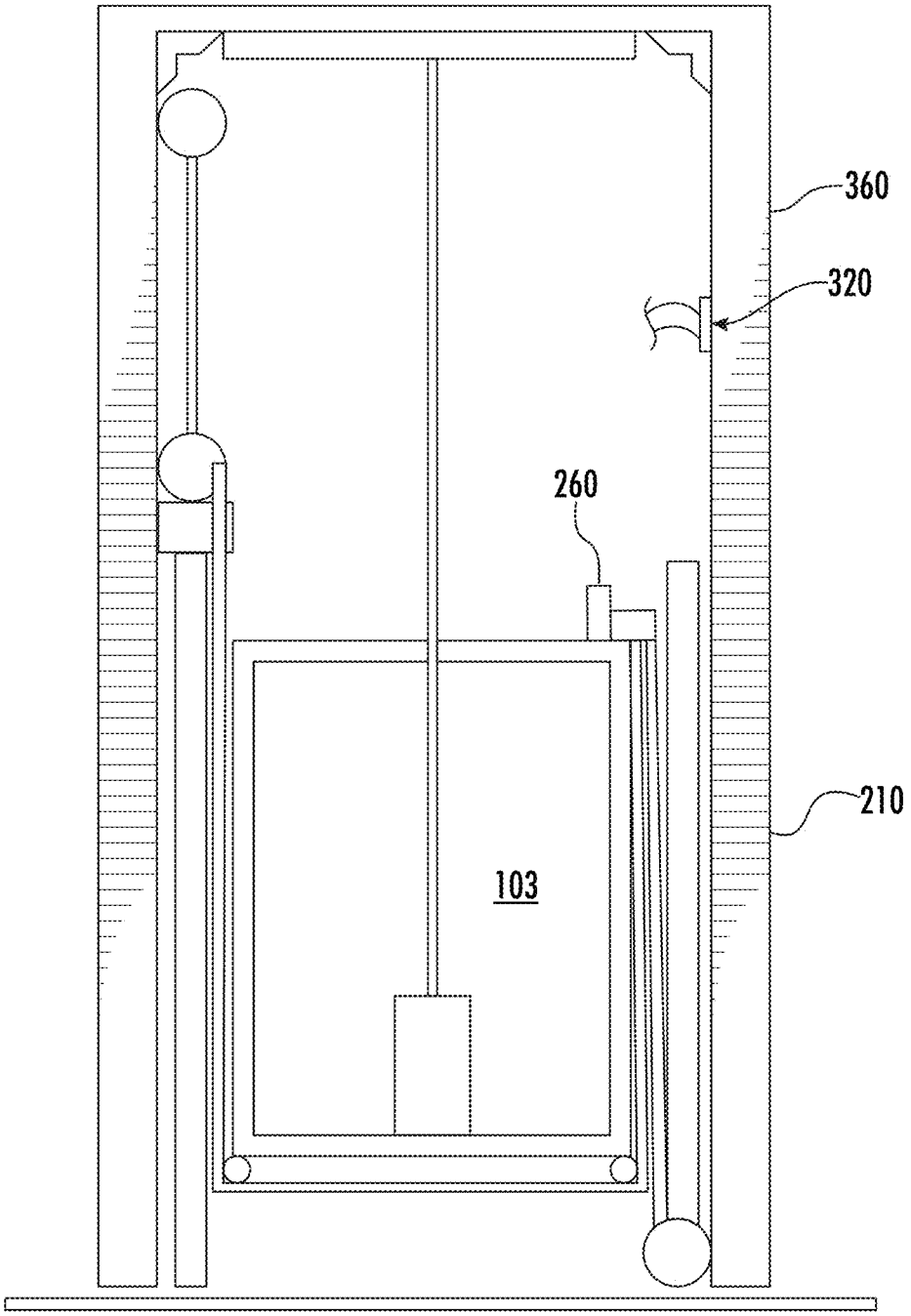
FIG. 7 shows a disconnecting of, e.g., a dead-end hitch (DEH) according to an embodiment.
Figure 8:
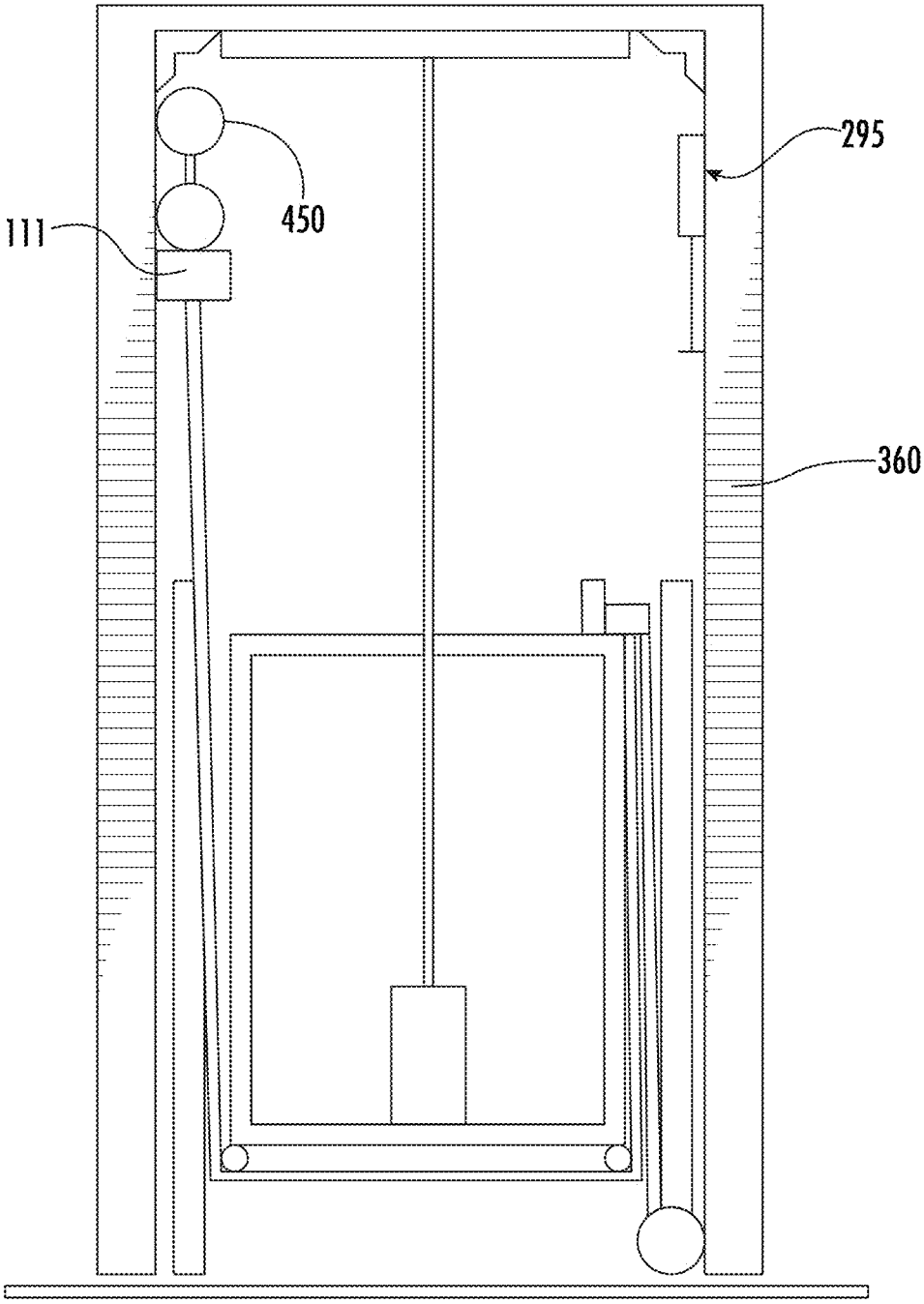
FIG. 8 shows a raising of the traction machine by a machine hoist according to an embodiment.

Turning to FIG. 6, a machine hoist 450, which is removable, is mounted to the hoist-beam 340. The machine hoist 450 is also mounted to the machine system 111. This enables lifting the machine system 111 to the second hoistway level 360. Turning to FIG. 7, the dead-end hitch 260 is dismounted from the first hoistway level 210 and prepared for being moved to the second hoistway level 360 by being attached to the elevator car 103. In addition, the system electronics 320 are disconnected. As shown in FIG. 8, the hoistway mounted brake implement 290 (FIG. 2) is extended to define an extended hoistway mounted brake implement 295. In one embodiment, the suspension implement 270 is extended with a utilization of the extension cable segment 430 located in the pit 410 (FIG. 2). In addition, the machine system 111 is hoisted via the machine hoist 450 to the second hoistway level 360.

Figure 9:
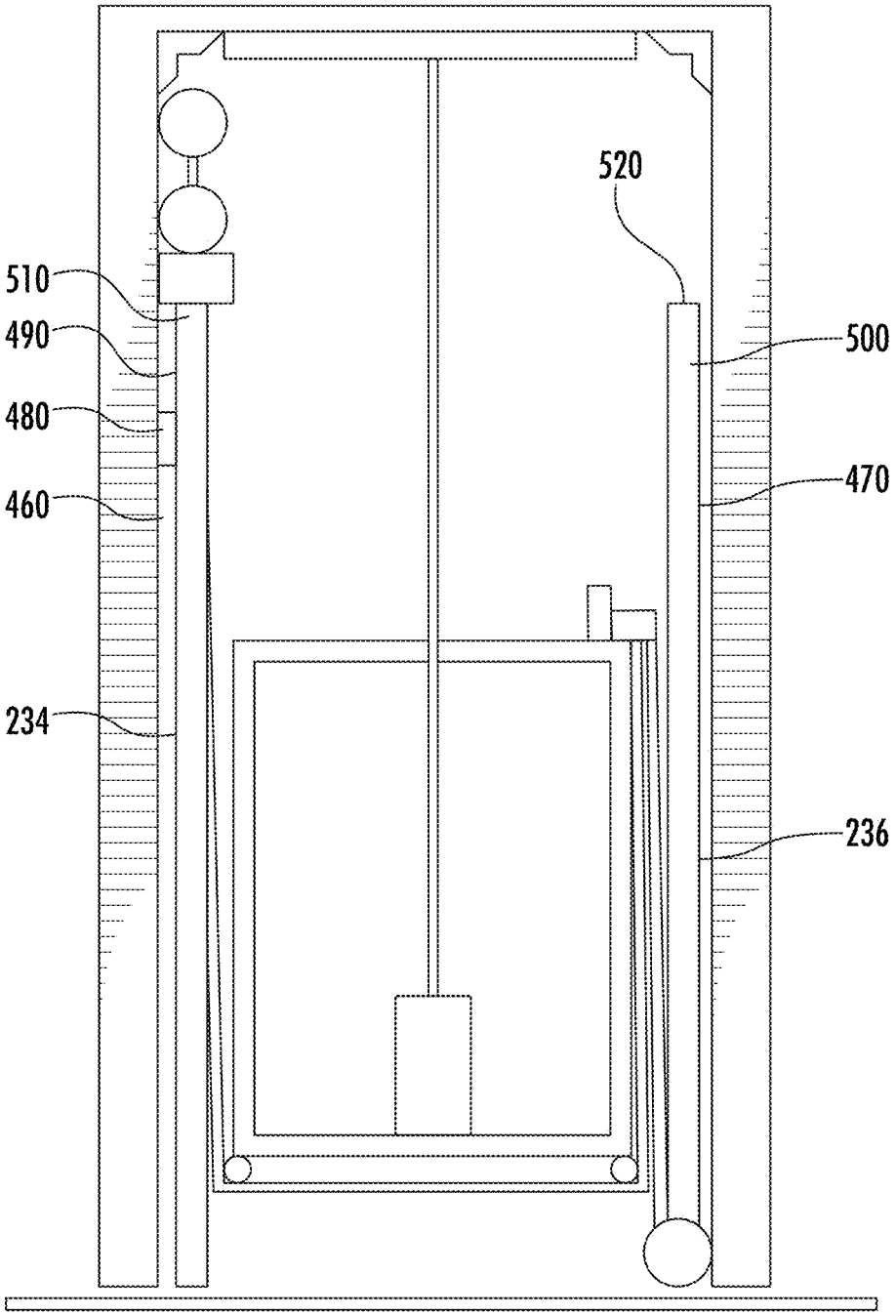
FIG. 9 shows an extending of the rails according to an embodiment.
Figure 10:
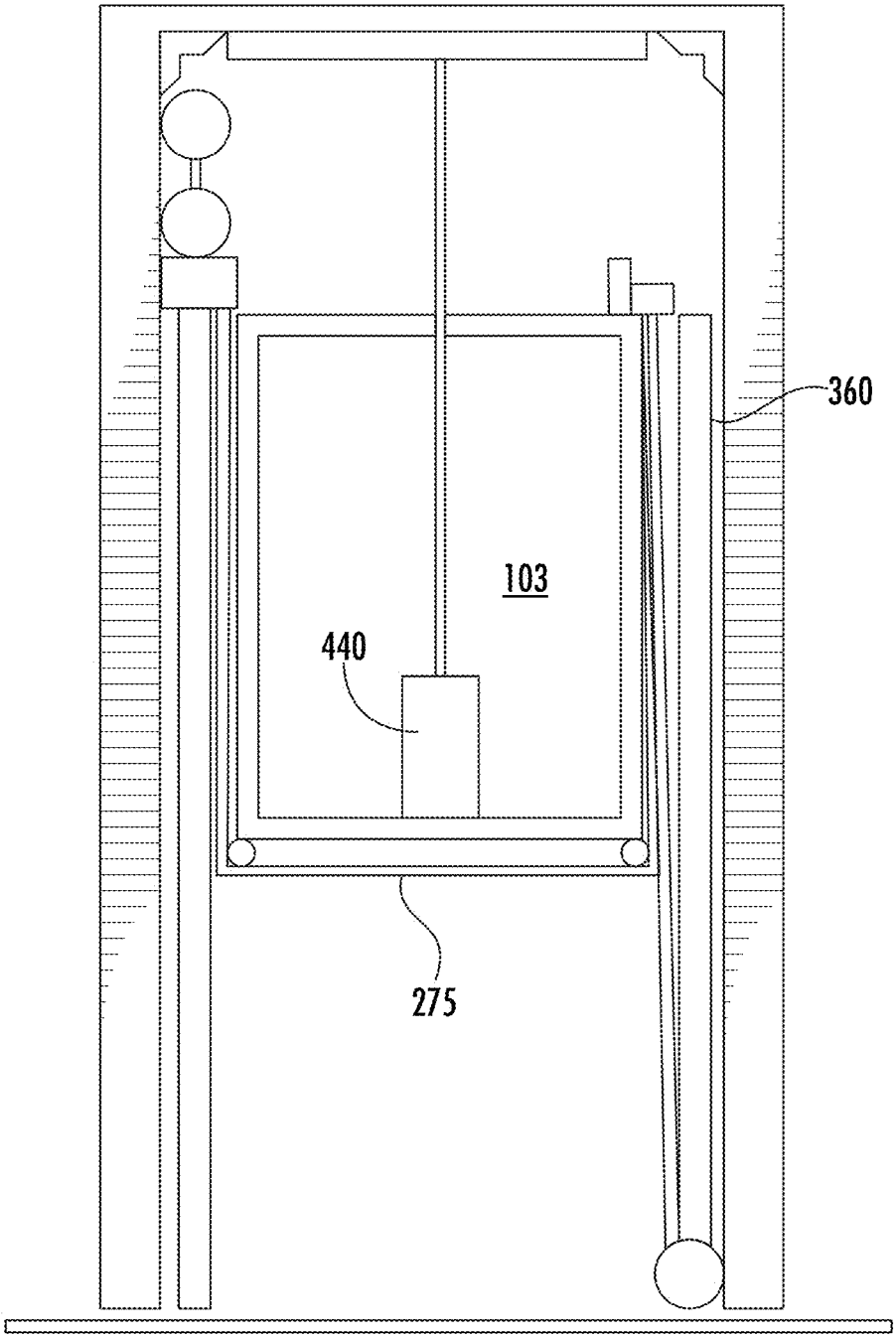
FIG. 10 shows a raising of the elevator car via an overhead winch according to an embodiment.

As shown in FIG. 9, first and second rail extension members 460, 470 are respectively installed over the first and second rail terminal ends 234, 236 of the first and second rails 220, 230 along with support brackets 480, to define first and second extended rails 490, 500. The first and second extended rails 490, 500 respectively include third and fourth rail terminal end 510, 520. As shown in FIG. 10, the elevator car 103 is hoisted via the overhead winch 440 to the second hoistway level 360. In addition, the suspension implement 270 (FIG. 2) is extended to define an extended suspension implement 275. In one embodiment, the suspension implement 270 is extended with a utilization of the extension belt segment 400 located in the pit 410 (FIG. 2). This implement is then reconnected.

Figure 11:
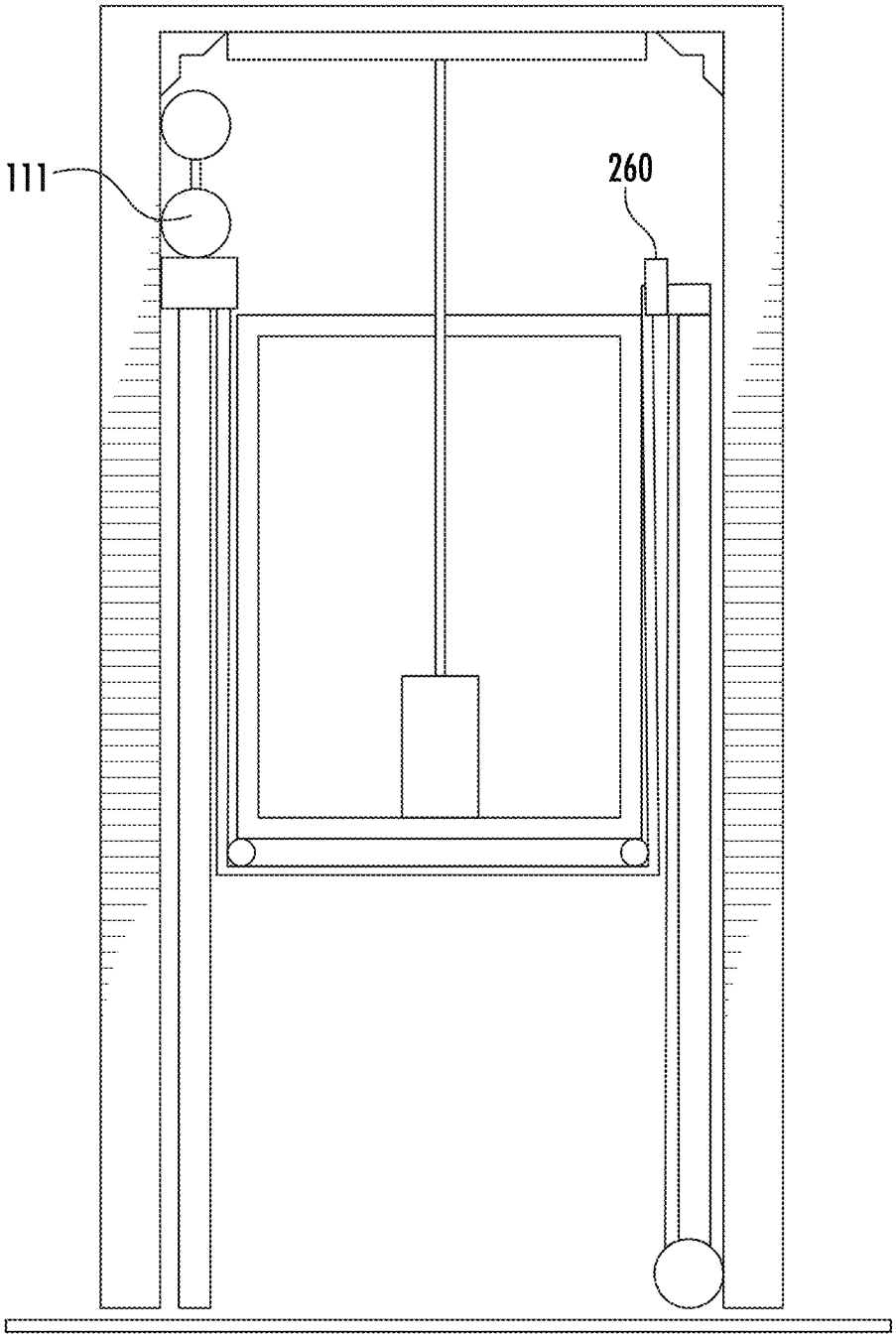
FIG. 11 shows a connecting of the traction machine and DEH to the extended rails according to an embodiment.

As shown in FIG. 11, the machine system 111 and the dead-end hitch 260 are respectively set atop of the third and fourth rail terminal ends 510, 520.

Figure 12:
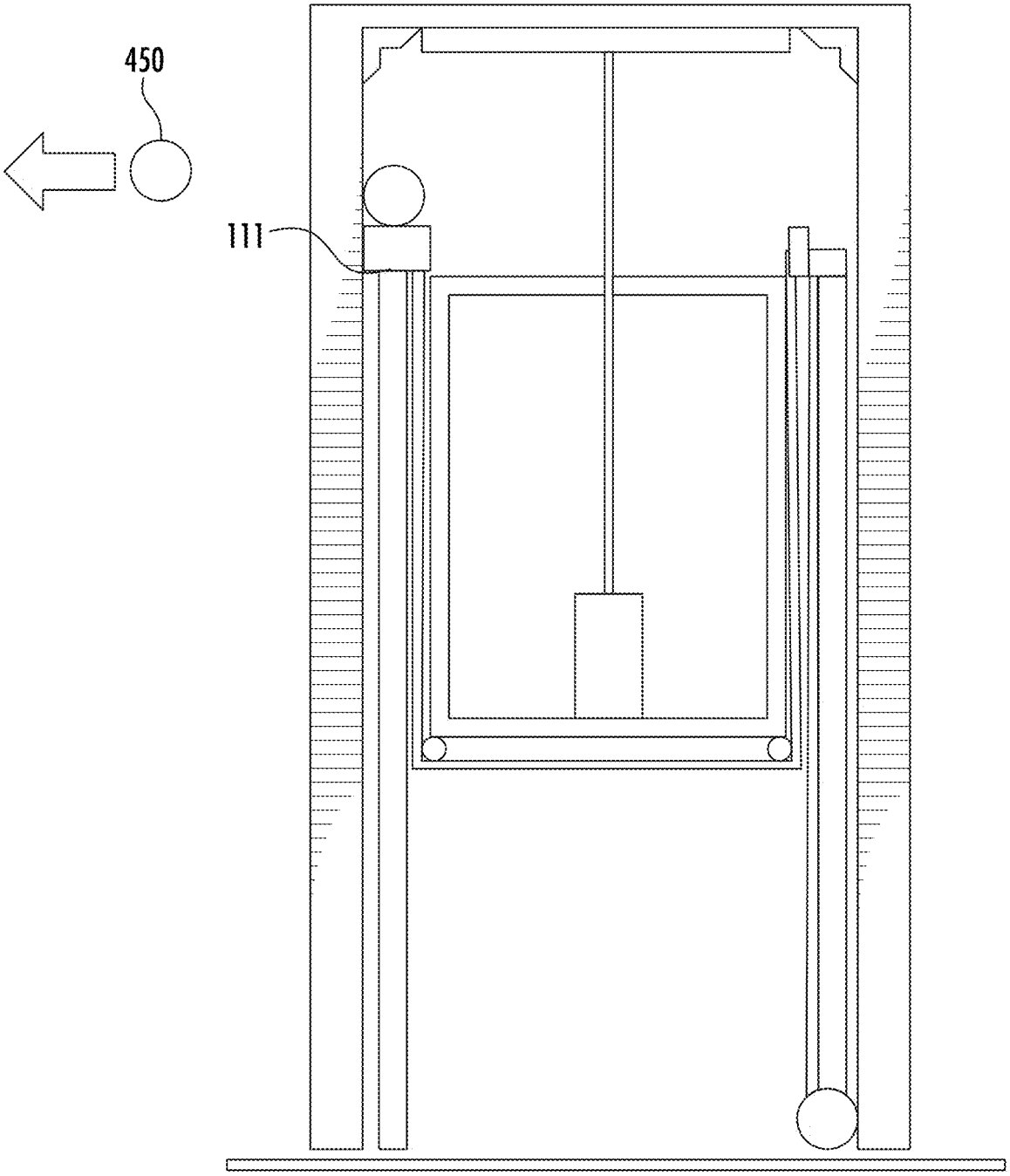
FIG. 12 show a removal of the machine hoist according to an embodiment.
Figure 13:
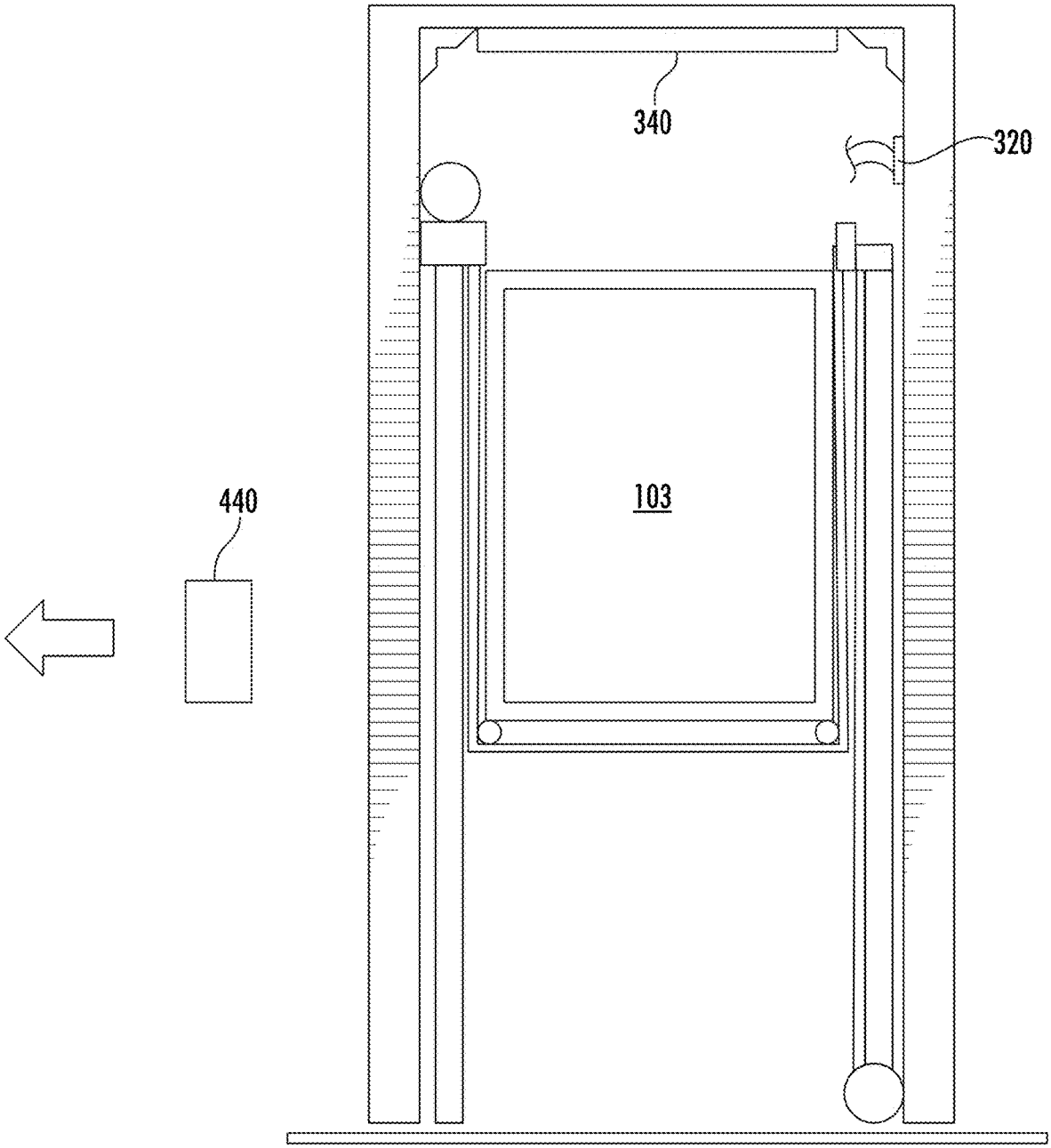
FIG. 13 shows a removal of an overhead winch according to an embodiment.

As shown in FIG. 12, the machine hoist 450 is removed from the machine system 111. As shown in FIG. 13, the overhead winch 440 is removed from the elevator car 103 and the hoist-beam 340. The system electronics 320 are reconnected to the elevator car 103. The elevator system 101 is tested and the elevator car 103 is returned to service.

Figure 14:
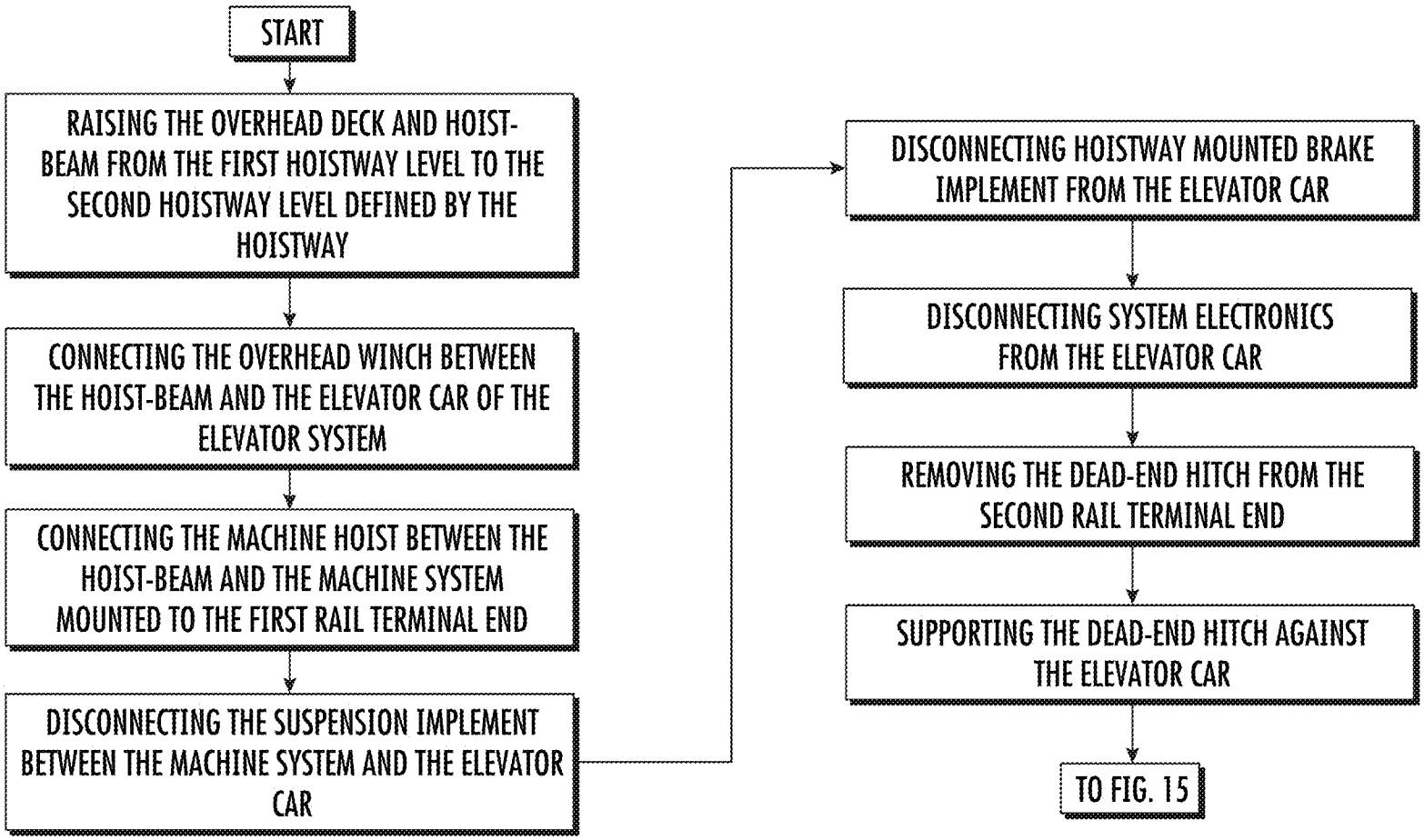
FIGS. 14-16 show a flowchart of a method of expanding an elevator system according to an embodiment.
Figure 15:
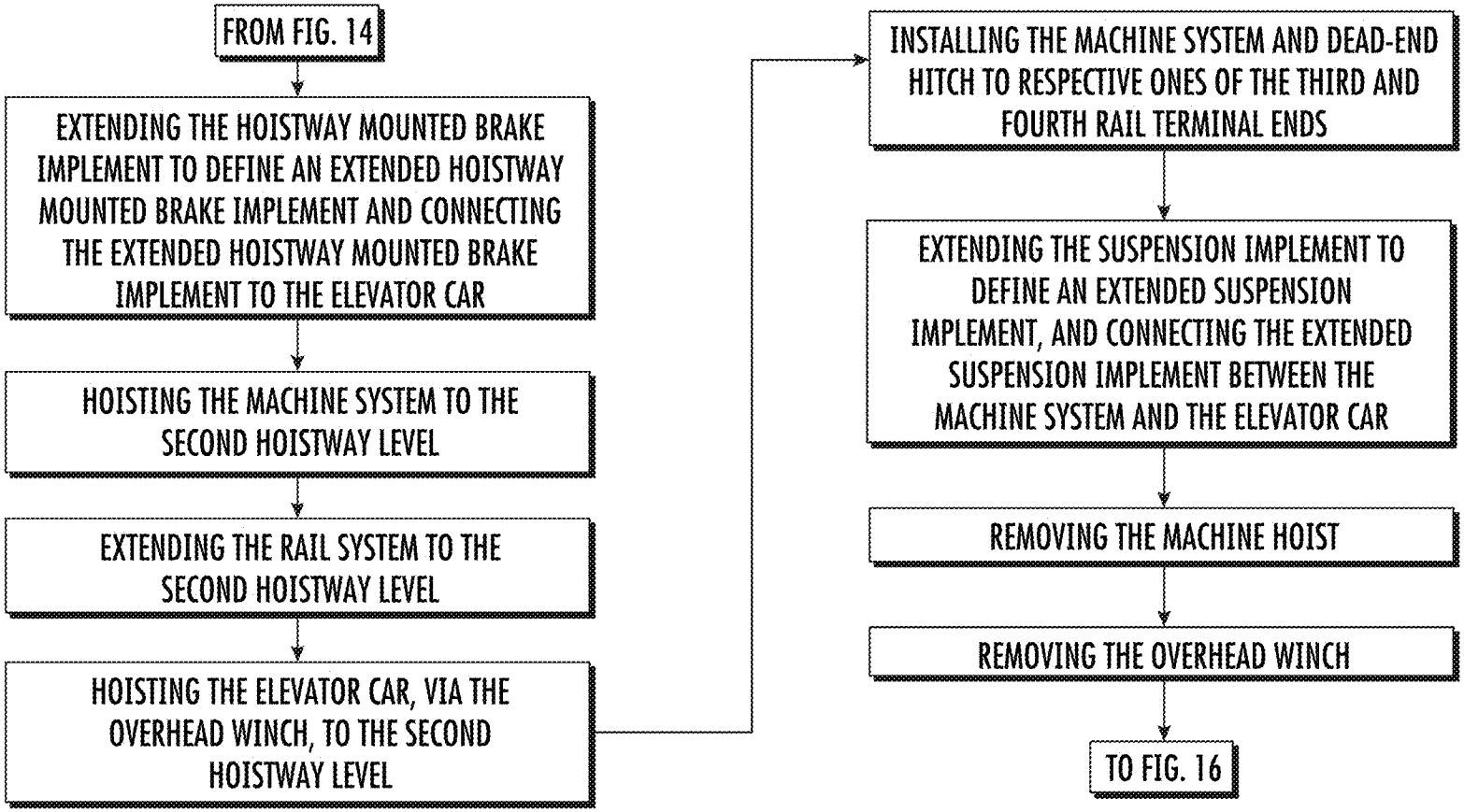
Figure 16:
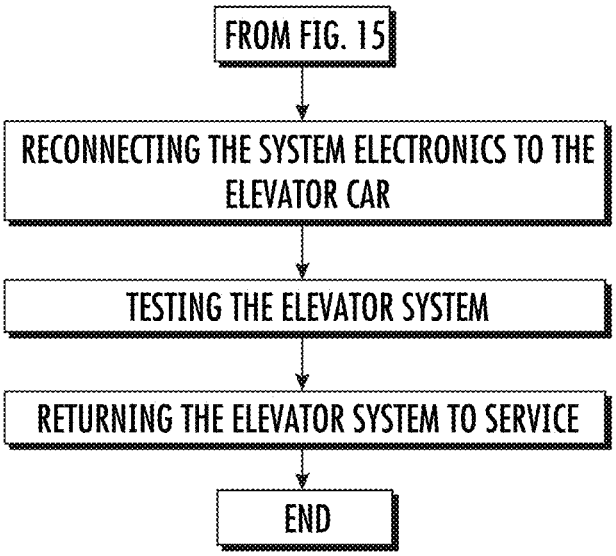

FIGS. 14-16 show a flowchart of a method of expanding of the elevator system 101 showing additional features of the disclosed embodiments. As shown in block 510, the method includes raising the overhead deck 330 and the hoist-beam 340 from the first hoistway level 210 to the second hoistway level 360 defined by the hoistway 117. This increases the rise of the hoistway.

As shown in block 520, the method includes connecting the overhead winch 440 between the hoist-beam 340 and the elevator car 103 of the elevator system 101. As indicated, the elevator car 103 is supported by the rail system 109 disposed in the hoistway 117, where the rail system 109 defines the first and second rails 220, 230, respectively having the first and second rail terminal ends 234, 236. In one embodiment, the rails are guide rails.

As shown in block 530, the method includes connecting the machine hoist 450 between the hoist-beam 340 and the machine system 111 mounted to the first rail terminal end 234. As indicated, in one embodiment, the machine system includes a traction machine 240 and its bedplate 250.

As shown in block 540, the method includes disconnecting a suspension implement 270 between the machine system 111 and the elevator car 103. In one embodiment, the suspension implement 270 includes a coated steel belt 280. As shown in block 550, the method includes disconnecting the hoistway mounted brake implement 290 from the elevator car 103. In one embodiment, the hoistway mounted brake implement 290 include the governor 300 and the governor cable 310. As shown in block 560, the method includes disconnecting the system electronics 320, which may be hoistway mounted, from the elevator car 103. In one embodiment, the system electronics 320 include the controller 115 (FIG. 1).

As shown in block 570, the method includes removing the dead-end hitch 260 from the second rail terminal end 236. As shown in block 580, the method includes supporting the dead-end hitch 260 against the elevator car 103.

As shown in block 590, the method includes extending the hoistway mounted brake implement 290 to define an extended hoistway mounted brake implement 295 and connecting the extended hoistway mounted brake implement 295 to the elevator car 103. In one embodiment, this includes: (i) relocating the governor to the second hoistway level; (ii) extending the governor cable to define an extended governor cable; and (iii) connecting the extended governor cable to the governor. In one embodiment, the suspension implement 270 is extended with a utilization of the extension cable segment 430 located in the pit 410.

As shown in block 600, the method includes hoisting the machine system 111 to the second hoistway level 360.

As shown in block 610, the method includes extending the rail system 109 to the second hoistway level 360. In one embodiment, this includes installing rail system extension members 460, 470 to the first and second rails 220, 230. This extends the rail system 109 to third and fourth rail terminal ends 510, 520 of respective ones of first and second extended rails 490, 500.

As shown in block 620, the method includes hoisting the elevator car 103, via the overhead winch 440, to the second hoistway level 360. As shown in block 630, the method includes installing the machine system 111 and dead-end hitch 260 to respective ones of the third and fourth rail terminal ends 510, 520 of the first and second extended rails 490, 500.

As shown in block 640, the method includes extending the suspension implement 270 to define an extended suspension implement 275, and connecting the extended suspension implement 270 between the machine system 111 and the elevator car 103. In one embodiment, the suspension implement 270 is extended with a utilization of the extension belt segment 400 located in the pit 410.

As shown in block 650, the method includes removing the machine hoist 450. As shown in block 660, the method includes removing the overhead winch 440. As shown in block 670, the method includes reconnecting the system electronics 320 to the elevator car 103. As shown in block 680, the method includes testing the elevator system 101. As shown in block 690, the method includes returning the elevator system 101 to service.

Figure 17:
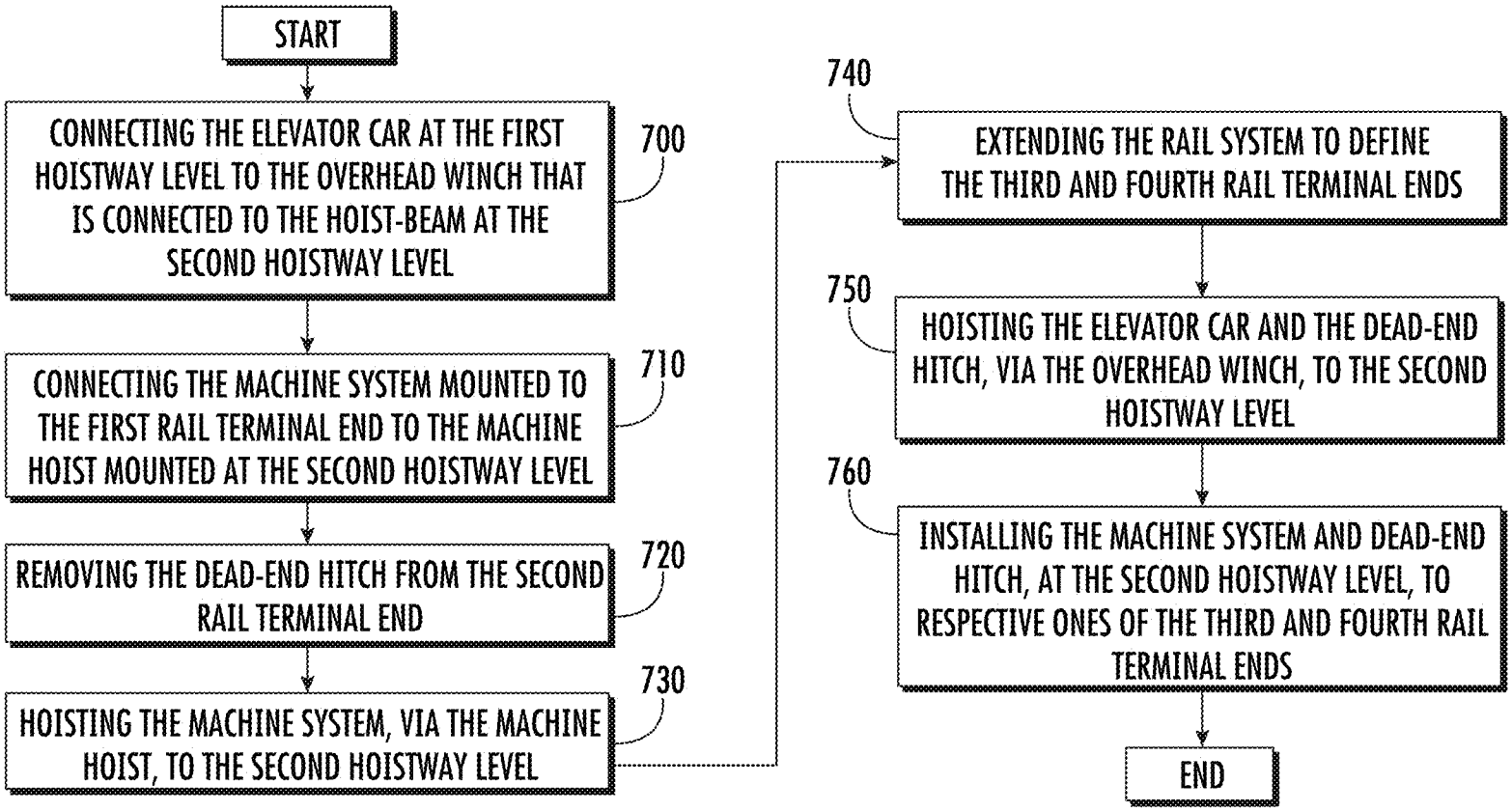
FIG. 17 show another flowchart of the method of expanding the elevator system according to another embodiment.

Turning to FIG. 17, another embodiment of the method of expanding an elevator system 101 in a hoistway 117 is shown. This embodiment includes a subset of the steps in FIGS. 14-16, with all other identified steps in those figures being optional. For example, as shown in block 700 (corresponding to block 520, above), the method includes connecting the elevator car 103 at the first hoistway level 210 to the overhead winch 440 that is connected to the hoist-beam 340 at the second hoistway level 360. As indicated, the elevator car 103 is supported by the rail system 109 disposed in the hoistway 117, and the rail system 109 defines, at the first hoistway level 210, first and second rails 220, 230 that respectively define first and second rail terminal ends 234, 236.

As shown in block 710 (corresponding to block 530, above), the method further includes connecting the machine system 111 mounted to the first rail terminal end 234 to the machine hoist 450 mounted at the second hoistway level 360. As shown in block 720 (corresponding to block 570, above), the method further includes removing the dead-end hitch 260 from the second rail terminal end 236. As shown in block 730 (corresponding to block 600, above), the method further includes hoisting the machine system 111, via the machine hoist 450, to the second hoistway level 360. As shown in block 740 (corresponding to block 610, above), the method further includes extending the rail system 109 to the second hoistway level 360 to define the third and fourth rail terminal ends 234, 236. As shown in block 750 (corresponding to block 620, above), the method further includes hoisting the elevator car 103 and the dead-end hitch 260, via the overhead winch 440, to the second hoistway level 360. As shown in block 760 (corresponding to block 630, above), the method includes installing the machine system 111 and the dead-end hitch 260 at the second hoistway level 360, to respective ones of the third and fourth rail terminal ends 234, 236.

The above disclosed embodiments provide an installation method for expanding a rise of an elevator in a hoistway. The embodiments utilize temporary guide rails, hoisting of the machine, bedplate and the dead-end hitch, the installation of more guide rails, and lengthening of the associated wiring. Hoistway Material are relocated to the new location, as indicated.

In some embodiments, temporary wiring may be used during the method. In some embodiments, elevator landing entrances may be preinstalled in the modular floor, e.g., prior to delivery of the modular floor to a construction site. In some embodiments, rail brackets may also be preinstalled in hoistway panels that form the hoistway, e.g., prior to delivery of the hoistway panels to a construction site. In some embodiments, rather than extending the steel belts, the steel belts are entirely replaced with longer steel belts. This would remove the need for belt monitoring instrumentation.

The terminology used herein is for the purpose of describing particular embodiments only and is not intended to be limiting of the present disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, element components, and/or groups thereof.

Those of skill in the art will appreciate that various example embodiments are shown and described herein, each having certain features in the particular embodiments, but the present disclosure is not thus limited. Rather, the present disclosure can be modified to incorporate any number of variations, alterations, substitutions, combinations, subcombinations, or equivalent arrangements not heretofore described, but which are commensurate with the scope of the present disclosure. Additionally, while various embodiments of the present disclosure have been described, it is to be understood that aspects of the present disclosure may include only some of the described embodiments. Accordingly, the present disclosure is not to be seen as limited by the foregoing description, but is only limited by the scope of the appended claims.

What is claimed is:

1. A method of expanding an elevator system in a hoistway, comprising:

connecting an elevator car at a first hoistway level to an overhead winch that is connected to a hoist-beam at a second hoistway level, wherein the elevator car is supported by a rail system disposed in the hoistway, wherein the rail system defines, at the first hoistway level, first and second rails that respectively define first and second rail terminal ends;

connecting a machine system mounted to the first rail terminal end to a machine hoist mounted at the second hoistway level;

removing a dead-end hitch from the second rail terminal end;

hoisting the machine system, via the machine hoist, to the second hoistway level;

extending the rail system to the second hoistway level to define third and fourth rail terminal ends;

hoisting the elevator car and the dead-end hitch, via the overhead winch, to the second hoistway level; and installing the machine system and the dead-end hitch at the second hoistway level, to respective ones of the third and fourth rail terminal ends.

2. The method of claim 1, wherein prior to connecting the elevator car to the overhead winch, the method includes:

raising an overhead deck and the hoist-beam from the first hoistway level to the second hoistway level, to thereby increase a rise of the hoistway.

3. The method of claim 2, wherein prior to hoisting the elevator car, the method includes:

disconnecting a suspension implement between the machine system and the elevator car;

disconnecting a hoistway mounted brake implement from the elevator car; and extending the hoistway mounted brake implement to define an extended hoistway mounted brake implement, and connecting the extended hoistway mounted brake implement to the elevator car;

and after hoisting the elevator car, the method includes:

extending the suspension implement to define extended suspension implement, and connecting the extended suspension implement between the machine system and the elevator car.

4. The method of claim 3, wherein:

between raising the overhead deck and connecting the machine system to the machine hoist, the method includes:

mounting the machine hoist at the second hoistway level; and after installing the dead-end hitch at the second hoistway level, the method includes:

removing the machine hoist.

5. The method of claim 3, wherein between raising the overhead deck and connecting the elevator car to the overhead winch, the method includes:

connecting the overhead winch to the hoist-beam; and after installing the dead-end hitch at the second hoistway level, the method includes:

removing the overhead winch.

6. The method of claim 3, wherein after removing the machine hoist and the overhead winch, the method includes:

testing the elevator system; and returning the elevator system to service.

7. The method of claim 3, wherein:

the hoistway mounted brake implement includes governor and a governor cable.

8. The method of claim 7, wherein:

extending the hoistway mounted brake implement includes:

(i) relocating the governor to the second hoistway level; (ii) extending the governor cable to define an extended governor cable; and (iii) connecting the extended governor cable to the governor.

9. The method of claim 3, wherein:

the suspension implement includes a coated steel belt.

10. The method of claim 1, comprising:

supporting the dead-end hitch against the elevator car prior to hoisting the elevator car to the second hoistway level.

11. The method of claim 1, wherein prior to hoisting the elevator car to the second hoistway level, the method includes:

disconnecting system electronics from the elevator car; and after hoisting the elevator car to the second hoistway level, the method includes:

reconnecting the system electronics to the elevator car.

12. The method of claim 11, wherein:

the system electronics include an electronic elevator controller.

13. The method of claim 1, wherein extending the rail system to the second hoistway level includes:

installing rail system extension members to the first and second rails, to define first and second extended rail members, wherein the first and second extended rail members define the third and fourth rail terminal ends at the second hoistway level.

14. The method of claim 1, wherein:

the rail system includes guide rails.

15. The method of claim 1, wherein:

the machine system includes a traction machine and its bedplate.

* * * * *